US008474381B2

(12) United States Patent
Streibich et al.

(10) Patent No.: US 8,474,381 B2
(45) Date of Patent: Jul. 2, 2013

(54) NON-EXPLOSIVE POWER SOURCE FOR ACTUATING A SUBSURFACE TOOL

(75) Inventors: Douglas J. Streibich, Fort Worth, TX (US); Mark Lancaster, Cleburne, TX (US); Michael C. Robertson, Arlington, TX (US)

(73) Assignee: Robertson Intellectual Properties, LLC, Arlington, TX (US)

( * ) Notice: Subject to any disclaimer, the term of this patent is extended or adjusted under 35 U.S.C. 154(b) by 0 days.

(21) Appl. No.: 13/506,655

(22) Filed: May 7, 2012

(65) Prior Publication Data

US 2012/0216701 A1 Aug. 30, 2012

Related U.S. Application Data

(63) Continuation of application No. 12/653,152, filed on Dec. 9, 2009, now Pat. No. 8,196,515.

(51) Int. Cl.
*C06D 5/00* (2006.01)

(52) U.S. Cl.
USPC ..... 102/531; 280/736; 280/737; 280/741

(58) Field of Classification Search
USPC ..... 102/531; 280/736, 737, 741; 166/63, 166/300
See application file for complete search history.

(56) References Cited

U.S. PATENT DOCUMENTS

| | | | | |
|---|---|---|---|---|
| 3,744,369 | A * | 7/1973 | Marziano et al. | 89/1.14 |
| 4,963,203 | A | 10/1990 | Halcomb et al. | |
| 5,396,951 | A | 3/1995 | Ross | |
| 5,725,699 | A | 3/1998 | Hinshaw et al. | |
| 5,994,610 | A | 11/1999 | Talmy et al. | |
| 6,102,120 | A | 8/2000 | Chen et al. | |
| 6,298,784 | B1 | 10/2001 | Knowlton et al. | |
| 6,627,013 | B2 | 9/2003 | Carter, Jr. et al. | |
| 6,651,747 | B2 | 11/2003 | Chen et al. | |
| 6,833,037 | B1 | 12/2004 | Hallam et al. | |
| 7,044,225 | B2 | 5/2006 | Haney et al. | |
| 7,290,609 | B2 | 11/2007 | Wardlaw et al. | |
| 7,555,986 | B2 * | 7/2009 | Givens et al. | 102/331 |
| 2003/0141063 | A1 * | 7/2003 | Haugen et al. | 166/297 |
| 2003/0145752 | A1 * | 8/2003 | Carter, Jr. | 102/335 |
| 2003/0145924 | A1 * | 8/2003 | Carter, Jr. | 149/37 |
| 2006/0266204 | A1 * | 11/2006 | Givens et al. | 89/1.14 |
| 2007/0284114 | A1 | 12/2007 | Swor et al. | |
| 2010/0096049 | A1 * | 4/2010 | Schroder | 149/3 |
| 2010/0279102 | A1 * | 11/2010 | Gangopadhyay et al. | 428/317.9 |
| 2011/0139505 | A1 * | 6/2011 | Huang et al. | 175/2 |
| 2011/0174504 | A1 * | 7/2011 | Wright et al. | 166/386 |

* cited by examiner

*Primary Examiner* — Samir Abdosh
(74) *Attorney, Agent, or Firm* — The Matthews Firm

(57) ABSTRACT

A power source for applying a force to an object includes thermite in a quantity sufficient to generate a thermite reaction, and a gas producing substance disposed in association with the thermite. The gas producing substance produces a gas when the thermite reaction. The thermite reaction, the gas, or combinations thereof provide a force to the object.

20 Claims, 1 Drawing Sheet

NON-EXPLOSIVE POWER SOURCE FOR ACTUATING A SUBSURFACE TOOL

CROSS-REFERENCE TO RELATED APPLICATIONS

The present application is a continuation application, claiming priority to the United States application for patent, having the Ser. No. 12/653,152, filed Dec. 9, 2009 now U.S. Pat. No. 8,196,515, the entirety of which is incorporated herein by reference.

FIELD

The present invention relates, generally, to a power source usable to actuate a subsurface tool.

BACKGROUND

Subsurface tools, placed downhole within a well, are used for a variety of purposes. Such tools can include packers or plugs, cutters, other similar downhole tools, and setting tools used in conjunction with such devices.

For example, in a typical downhole operation, a packer can be lowered into a well and positioned at a desired depth, and a setting tool can be positioned above the packer in operative association therewith. An explosive power charge is then provided in conjunction with the setting tool. When it is desired to set the packer, the power charge is initiated, which causes gas to be rapidly produced, forcefully driving a movable portion of the setting tool into a position to actuate the packer to seal a desired area of the well. The gas can also provide sufficient force to shear a shear pin or similar frangible member to separate the setting tool from the packer.

The force applied to a subsurface tool by a power charge and/or a setting tool must be carefully controlled. The force must be sufficient to set a packer or to similarly actuate a downhole tool; however, excessive force can damage portions of the downhole tool, rendering it ineffective. Additionally, the power charge must be configured to provide force for a sufficient period of time. An explosive force provided for an extremely short duration can fail to actuate a tool, and in many cases a "slow set" is preferred due to favorable characteristics provided when actuating a tool in such a manner. For example, when setting a packer, a "slow set" provides the packer with improved holding capacity.

Conventional power charges are classified as explosive devices. Most power charges include black powder and/or ammonium perchlorate, and are configured to provide a short, forceful pressure to a subsurface tool to actuate the tool. An explosive force can often create shockwaves within a well bore, which can undesirably move and/or damage various tools and other components disposed within.

Classification of power charges as explosive devices creates numerous difficulties relating to their transport and use. Shipment of explosive devices on commercial carriers, such as passenger and cargo airplanes, is prohibited. Further, shipment of explosive devices via most trucking companies or similar ground transport is also prohibited. Permissible truck, rail, and ship-based modes of transport are burdened by exacting and costly requirements. Shipments of explosives by rail require buffering areas around an explosive device, resulting in inefficient spacing of cargo with increased cost to the shipper. Shipments by truck require use of vehicles specifically equipped and designated to carry explosive devices, which is a costly process due to the hazards involved. Shipment using ships is subject to regulation by port authorities of various nations, grounded in national security concerns, which greatly increases the time and expense required for the shipment.

The difficulties inherent in the shipment of explosive devices are complicated by the fact that numerous oil and gas wells requiring use of power charges are located in remote locales, which are subject to various national and local regulations regarding explosive devices, and which often require numerous modes of transportation and numerous carriers to reach.

Operation of explosive power charges is also restricted, depending on the location in which an operation is to be performed. In many locations, the user of a power charge must be specifically licensed to handle and operate explosive devices. Some nations do not allow transport or use of explosive devices within their borders without obtaining a special permit to requisition a desired explosive device from a designated storage area. In others, various governmental agents or other specialists must be present to ensure safe operation of the device.

In addition to the regulatory difficulties present when using an explosive power charge, the explosive nature of conventional power charges can also inhibit the effectiveness of such devices.

In some instances, a packer or similar subsurface tool can become misaligned within a wellbore. Use of an explosive power charge to provide a short, powerful burst of pressure to actuate the tool can cause the tool to set, or otherwise become actuated, in a misaligned orientation, hindering its effectiveness. While conventional power charges are configured to provide a sustained pressure over a period of time, this period of time is often insufficient to allow a misaligned tool to become realigned within a wellbore, while a longer, slower application of pressure (a "slow set") can cause a tool to become aligned as it is actuated. Additionally, a longer, slower application of pressure to a subsurface tool can improve the quality of the actuation of the tool, as described previously.

A further complication encountered when using explosive power charges relates to the heat transfer created by the device. Conventional power charges can heat a subsurface tool to temperatures in excess of 2,000 degrees Fahrenheit. These extreme temperatures can cause excessive wear to tool components, leading to the degradation of one or more portions of the tool.

A need exists for a power source, usable as an alternative to conventional power charges, that does not contain explosive substances, thereby avoiding the difficulties inherent in the transport and use of explosive devices.

A further need exists for a power source that provides a continuous pressure to a subsurface tool over an extended period of time, enabling alignment of misaligned tools and improving the quality of the actuation of the subsurface tool, while providing an aggregate pressure equal to or exceeding that provided by conventional power charges.

A need also exists for a power source that provides pressure sufficient to actuate a subsurface tool without increasing the temperature of the tool to an extent that can cause significant damage or degradation.

The present invention meets these needs.

SUMMARY

The present invention relates, generally, to a power source, usable to actuate a variety of subsurface tools, such as packers, plugs, cutters, and/or a setting tool operably associated therewith. The present power source incorporates use of non-explosive, reactive components that can provide a pressure sufficient to actuate a subsurface tool. The aggregate pressure provided during the reaction of the components can equal or exceed that provided by a conventional explosive power charge. By omitting use of explosive components, the present power source is not subject to the burdensome restrictions relating to use and transport of explosive devices, while providing a more continuous pressure over a greater period of time than a conventional explosive power charge.

In an embodiment of the invention, the present power source includes thermite, present in a quantity sufficient to generate a thermite reaction. Thermite is a mixture that includes a powdered or finely divided metal, such as aluminum, magnesium, chromium, nickel, and/or similar metals, combined with a metal oxide, such as cupric oxide, iron oxide, and/or similar metal oxides. The ignition point of thermite can vary, depending on the specific composition of the thermite mixture. For example, the ignition point of a mixture of aluminum and cupric oxide is about 1200 degrees Fahrenheit. Other thermite mixtures can have an ignition point as low as 900 degrees Fahrenheit.

When ignited, the thermite produces a non-explosive, exothermic reaction. The rate of the thermite reaction occurs on the order of milliseconds, while an explosive reaction has a rate occurring on the order of nanoseconds. While explosive reactions can create detrimental explosive shockwaves within a wellbore, use of a thermite-based power charge avoids such shockwaves.

The power source also includes a gas producing substance and/or compound disposed in association with the thermite. Pressure from the gas produced is usable to actuate a subsurface tool, such as by causing movement of a movable portion of a tool from a first position to a second position. In a preferred embodiment, the substance and/or compound includes a polymer that that produces gas responsive to the thermite reaction, and as such, the present application will refer to use of a "polymer" throughout; however, it should be understood that the term "polymer" is used synonymously with any substance that can produce gas responsive to a thermite reaction.

Usable polymers can include, without limitation, polyethylene, polypropylene, polystyrene, polyester, polyurethane, acetal, nylon, polycarbonate, vinyl, acrylin, acrylonitrile butadiene styrene, polyimide, cylic olefin copolymer, polyphenylene sulfide, polytetrafluroethylene, polyketone, polyetheretherketone, polytherlmide, polyethersulfone, polyamide imide, styrene acrylonitrile, cellulose propionate, diallyl phthalate, melamine formaldehyde, other similar polymers, or combinations thereof.

In a preferred embodiment of the invention, the polymer can take the shape of a container, disposed exterior to and at least partially enclosing the thermite. Other associations between a polymer and thermite are also usable, such as substantially mixing the polymer with the thermite, or otherwise combining the polymer and thermite such that the polymer produces gas responsive to the thermite reaction. For example, a usable polymer can be included within a thermite mixture as a binding agent. In an embodiment of the invention, a polymer can be present in an amount ranging from 110% the quantity of thermite to 250% the quantity of thermite, and in a preferred embodiment, in an amount approximately equal to 125% the quantity of thermite.

Use of a power source that includes thermite and a polymer that produces gas when the thermite reaction occurs provides increased pressure when compared to reacting thermite without a polymer. Use of thermite alone can frequently fail to produce sufficient pressure to actuate a subsurface tool.

The gas produced by the polymer can slow the thermite reaction, while being non-extinguishing of the thermite reaction, which enables the power source to provide a continuous pressure over a period of time. In an embodiment of the invention, the thermite reaction, as affected by the gas, can occur over a period of time in excess of one minute. The aggregate pressure produced by the power source over the time within which the thermite reaction occurs can exceed the pressure provided by a conventional explosive power charge. Additionally, use of a continuous pressure, suitable for a "slow set," can improve the quality of the actuation of certain subsurface tools, such as packers. Further, when a packer or a similar tool has become misaligned in a borehole, application of a continuous, steadily increasing pressure over a period of time can cause the misaligned tool to straighten as it is actuated. Use of an explosive burst of force provided by a conventional power charge would instead cause a misaligned tool to become actuated in an improper orientation.

In embodiments of the invention where a "slow set" is not desired, such as when actuating a subsurface tool requiring pressure to be exerted for a period of time less than that of the thermite reaction, one or more accelerants can also be included within the power source. For example, inclusion of magnesium or a similar accelerant, in association with the thermite and/or the polymer can cause a reaction that would have occurred over a period of two to three minutes to occur within ten to twenty seconds.

In a further embodiment of the invention, the polymer and/or the gas can reduce the heat transfer from the thermite reaction to the subsurface tool, or another adjacent object. While typically, the exothermic thermite reaction can increase the temperature of an adjacent subsurface tool by up to 6,000 degrees Fahrenheit, potentially causing wear and/or degradation of the tool, an embodiment of the present power source can include a quantity and configuration of thermite and polymer that controls the heat transfer of the reaction such that the temperature of an adjacent subsurface tool is increased by only 1000 degrees Fahrenheit or less. During typical use, the present power source can increase the temperature of an adjacent tool by only 225 degrees Fahrenheit or less.

In operation, a power source, as described above, can be provided in operative association with a movable member of a subsurface tool. For example, a packer secured to a setting tool, having a piston or mandrel used to actuate the packer, can be lowered into a wellbore, the power source being placed adjacent to, or otherwise in operative association with, the piston or mandrel. A thermal generator, torch, or similar device usable to begin the thermite reaction can be provided in association with the thermite.

When the tool has been lowered to a selected depth and it is desirable to actuate the tool, the thermal generator can be used to initiate the thermite reaction, such as by providing current to the thermal generator through electrical contacts with a source of power located at the well surface. The power source can also be actuated using a self-contained thermal generator that includes batteries, a mechanical spring, and/or another source of power usable to cause the thermal generator to initiate the thermite reaction. Initiation of the reaction can be manual, or the reaction can be initiated automatically, responsive to a number of conditions including time, pressure, temperature, motion, and/or other factors or conditions, through use of various timers and/or sensors in communication with the thermal generator.

As the thermite reacts, the polymer produces gas, and the gas from the polymer and/or the thermite reaction applies a pressure to the movable member sufficient to actuate the subsurface tool. The gas from the polymer slows the thermite reaction, thereby enabling, in various embodiments of the invention, provision of a continuous pressure to the movable member over a period of time, and/or prevention of excessive heat transfer from the thermite reaction to the subsurface tool. The thermite reaction can provide a continuous, increasing pressure such that if a packer or similar tool has become misaligned, pressure from the power source will push the tool into alignment prior to actuating the tool.

The force provided by the power source can be controlled by varying the quantity of thermite and/or the quantity of polymer. In an embodiment of the invention, the force provided by the power source can be used to perform actions subsequent to actuating the subsurface tool. For example, after actuating a setting tool to cause setting of a packer, the force from the power source can shear a shear pin or similar item to cause separation of the setting tool from the packer.

Embodiments of the present power source thereby provide a non-explosive alternative to conventional explosive power charges, that can provide a continuous pressure over a period of time that equals or exceeds the aggregate pressure provided by conventional alternatives, and can reduce heat transfer from the power source to a subsurface tool.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Figure 1:
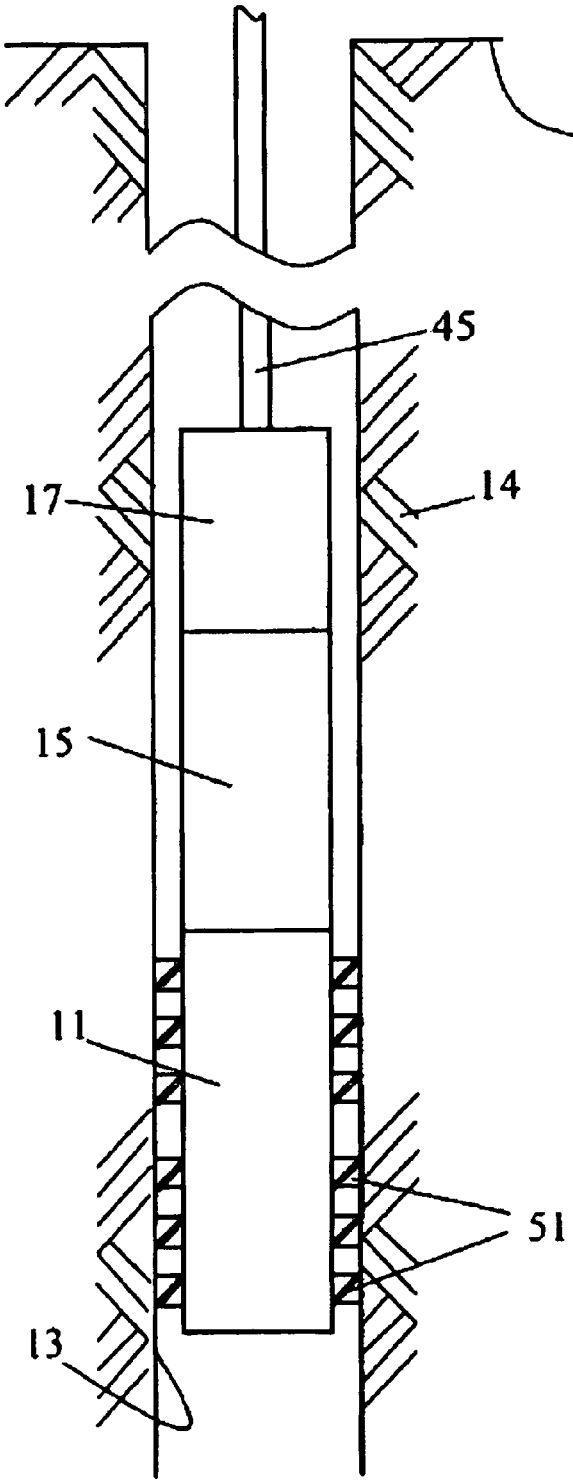
FIG. 1 depicts an embodiment of a subsurface tool within a wellbore, in operative association with an embodiment of the present power source.

Referring now to FIG. 1, an embodiment of the present power source is shown within a wellbore, in operative association with a subsurface tool.

Specifically, FIG. 1 depicts a wellbore (13), drilled within the earth (14), extending from the surface (16) to a desired depth. The wellbore has a packer (11) disposed therein. While FIG. 1 depicts a cased wellbore (13), it should be noted that embodiments of the power source are usable within any type of hole or opening, including cased or uncased wells, open holes, mines, platforms over subsurface openings, or other similar subsurface locations beneath land or water, as well as above-ground locations where production of a gas and/or pressure is desirable to actuate a tool and/or for other purposes. Additionally, while FIG. 1 depicts the wellbore (13) containing a packer (11), embodiments of the present power source are usable to actuate any type of subsurface tool, including without limitation, packers, plugs, cutters, setting tools, and other devices able to be actuated using pressure.

The packer (11) is shown in operative association with a setting tool (15), usable to actuate the packer (11). Exemplary setting tools can include such tools as Baker No. 10 and No. 20, from Baker Oil Tools. Another exemplary setting tool is described in U.S. Pat. No. 5,396,951, the entirety of which is incorporated herein by reference. Through actuation by the setting tool (15), the packer (11) deploys sealing members (51) against the inner circumference of the wellbore (13).

Figure 2:
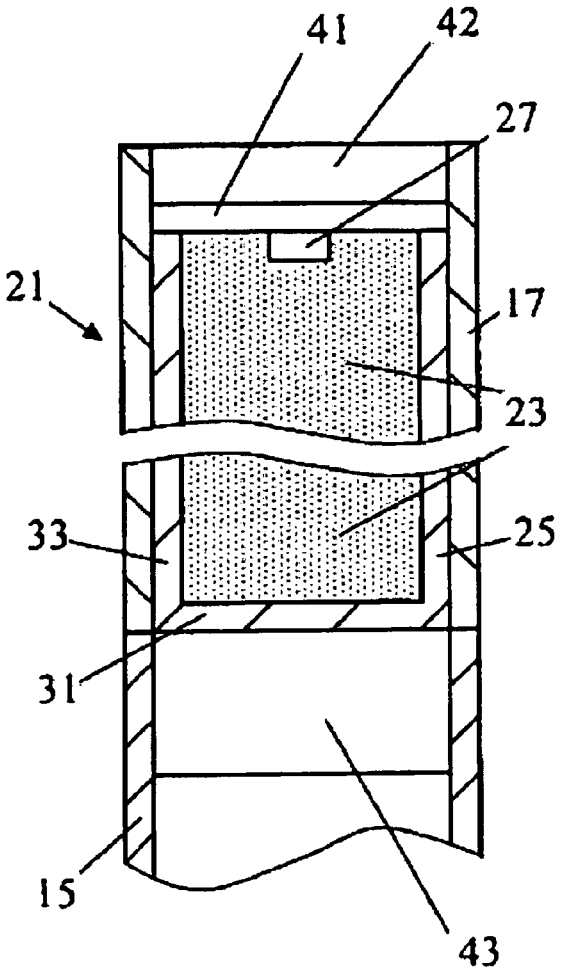
FIG. 2 depicts a cross-sectional view of an embodiment of the present power source.

A firing head (17) is shown coupled to the setting tool (15), the firing head (17) containing an embodiment of the present power source (not visible in FIG. 1). The power source within the firing head (17) is operatively coupled with a movable member of the setting tool (15) (for example a movable piston (43), as shown in FIG. 2), such that gas produced by the power source applies, to the setting tool (15), a pressure sufficient to cause actuation of the setting tool (15). An electrical conduit (45) is shown connecting the firing head (17) to a source of power (not shown) disposed at the surface (16), for ignition of the power source. Other sources of power, such as batteries, a downhole source of power, a mechanical source of power, or similar sources of power, are also usable, such that a electrical connection between the firing head (17) and the surface (16) is not required.

Referring now to FIG. 2, an embodiment of the present power source (21) is shown, disposed within the firing head (17). The power source (21) is shown including a quantity of thermite (23), partially encased by a polymer (25), the polymer (25) defining a bottom wall (31) and a side wall (33). In one or more embodiments of the invention, the bottom wall (31) and/or the side wall (33) can be omitted, and the thermite (23) can be pressed against a stop or wall within the firing head (17) or against the setting tool (15).

The top of the thermite (23) is shown enclosed by a cap (41). The firing head (17) can also include an outer cap (42), which is shown enclosing the power source (21) contained within, enabling the entirety of the pressure produced by the power source (21) to be contained for actuating a movable member, shown as a piston (43) within the setting tool (15), by directing the pressure produced by the power source (21) in a downhole direction. A thermal generator (27) is shown disposed in contact with the thermite (23) for initiating the thermite reaction. An electrical conduit (such as that depicted in FIG. 1), or a similar source of energy is usable to activate the thermal generator (27). A typical thermal generator can produce heat sufficient to ignite the thermite (23) responsive to electrical current. An exemplary thermal generator is shown and described in U.S. Pat. No. 6,925,937, the entirety of which is incorporated herein by reference. Usable thermal generators can include any source of heat for initiating the thermite reaction, including direct contact between heating elements and the thermite or use of a heat source in communication with a separate controlled quantity of thermite used to initiate the thermite reaction within the power source (21).

While the polymer (25) is shown having the structural form of a container or sleeve for containing or otherwise partially or wholly enclosing the thermite (23), the polymer (25) can be combined with the thermite (23) in any manner that permits the polymer (25) to produce gas responsive to the thermite reaction.

Thermite includes as a mixture of powdered or finely divided metals and metal oxides that reacts exothermically when ignited. The resulting thermite reaction is classified as non-explosive, the reaction occurring over a period of milliseconds, rather than nanoseconds. Specifically, thermite can include powdered aluminum, magnesium, chromium, nickel, or other similar metals, mixed with cupric oxide, iron oxide, or other similar metal oxides. In a preferred embodiment of the invention, the thermite (23) includes a mixture of aluminum and cupric oxide.

The polymer (25) can include any polymer or copolymer, including but not limited to polyethylene, polypropylene, polystyrene, polyester, polyurethane, acetal, nylon, polycarbonate, vinyl, acrylin, acrylonitrile butadiene styrene, polyimide, cylic olefin copolymer, polyphenylene sulfide, polytetrafluroethylene, polyketone, polyetheretherketone, polytherlmide, polyethersulfone, polyamide imide, styrene acrylonitrile, cellulose propionate, diallyl phthalate, melamine formaldehyde, or combinations thereof.

The quantity of polymer (25) within the power source (21) can be varied, in relation to the quantity of thermite (23), depending on the subsurface tool to be set. For example, when setting a packer, approximately 25% more polymer than thermite, by weight, can be used. In other embodiments of the invention, the quantity of polymer can range from 110% the quantity of thermite to 250% the quantity of thermite, by weight. It should be understood, however, that any quantity of polymer in relation to the quantity of thermite can be used, depending on the desired characteristics of the power source and the pressure to be produced.

In an embodiment of the invention, the power source (21) can also include an accelerant (not shown), such as magnesium, mixed or otherwise associated with the thermite (23) and/or the polymer (25).

In operation, electrical current is provided to the thermal generator (27), via the electrical conduit (depicted in FIG. 1) or using another similar source of power. once the thermal generator (27) reaches the ignition temperature of the thermite (23), the thermite (23) begins to react. Heat from the thermite reaction heats the polymer (25), which causes the polymer to produce gas, which is at least partially consumed by the thermite reaction, thereby slowing the reaction. Absent the polymer (25), the thermite would react rapidly, in a manner of seconds or less. Through use of the polymer (25) to attenuate the reaction, the thermite reaction can occur over several minutes, generally from one to three minutes. The gas produced by the polymer (25) further increases the overall gas pressure produced by the thermite reaction.

The gas from the polymer (25) and/or the thermite reaction, confined by the outer cap (42), breaches the bottom wall (31) to apply pressure to the piston (43), thereby actuating the subsurface tool (15). The thermite reaction is not temperature sensitive, thus, the power source (21) is unaffected by the temperature of the downhole environment, enabling a reliable and controllable pressure to be provided by varying the quantity of thermite (23) and polymer (25) within the power source (21). Through provision of a "slow set" to a packer or similar tool, such as a continuous pressure for a period of one minute or longer, elastomeric sealing elements obtain greater holding capacity than sealing elements that are set more rapidly.

Subsequent to the thermite reaction, the thermite (23) and polymer (25) can be substantially consumed, such that only ash byproducts remain. The quantity of thermite (23) and/or polymer (25) can be configured to vary the reaction rate and the pressure provided by the reaction. For example, the length of the firing head (17) can be extended to accommodate a larger quantity of thermite (23) and/or polymer (25) when a longer reaction is desired. Similarly, a longitudinal hole or similar gap can be provided within the thermite (23) to shorten the reaction time.

While various embodiments of the present invention have been described with emphasis, it should be understood that within the scope of the appended claims, the present invention might be practiced other than as specifically described herein.

What is claimed is:

1. A power source for actuating a subsurface tool, the power source comprising:

a quantity of thermite sufficient to generate a thermite reaction when heated in excess of an ignition temperature; and a polymer disposed in association with the thermite, wherein the polymer produces a gas when the thermite reaction occurs, wherein the gas slows the thermite reaction, wherein pressure produced by the thermite reaction, the gas, or combinations thereof, is applied to the subsurface tool to actuate the subsurface tool, and wherein applying the pressure produced by the thermite reaction, the gas, or combinations thereof to the subsurface tool comprises applying the pressure produced by the thermite reaction, the gas, or combinations thereof to a movable member, causing the movable member to move from a first position to a second position.

2. The power source of claim 1, wherein the gas produced by the polymer is non-extinguishing of the thermite reaction.

3. The power source of claim 1, wherein the polymer comprises a container shape configured to at least partially enclose the thermite, and wherein the polymer is disposed exterior to the thermite.

4. The power source of claim 1, wherein the polymer is substantially mixed with the quantity of thermite.

5. The power source of claim 1, wherein the polymer, the gas, or combinations thereof, reduce heat transfer from the thermite reaction to an adjacent object.

6. The power source of claim 5, wherein the heat transfer from the thermite reaction to the adjacent object raises the temperature of the adjacent object by 1000 degrees Fahrenheit or less.

7. The power source of claim 1, wherein the gas slows the thermite reaction such that the thermite reaction occurs for a time greater than or equal to one minute.

8. The power source of claim 1, wherein the polymer comprises polyethylene, polypropylene, polystyrene, polyester, polyurethane, acetal, nylon, polycarbonate, vinyl, acrylin, acrylonitrile butadiene styrene, polyimide, cylic olefin copolymer, polyphenylene sulfide, polyketone, polyetheretherketone, polyetherimide, polyethersulfone, polyamide imide, styrene acrylonitrile, cellulose propionate, diallyl phthalate, melamine formaldehyde, or combinations thereof.

9. The power source of claim 1, wherein the polymer is present in a quantity ranging from 110% the quantity of thermite by weight to 250% the quantity of thermite by weight.

10. The power source of claim 1, further comprising an accelerant, wherein the accelerant increases the rate at which the thermite reaction occurs.

11. A method for applying a force to an object, the method comprising the steps of:

providing a power source into association with a movable member, wherein the power source comprises: a quantity of thermite sufficient to generate a thermite reaction when heated in excess of an ignition temperature, and a gas producing substance disposed in association with the thermite and adapted to produce a gas when the thermite reaction occurs; and heating the thermite to or in excess of the ignition temperature, thereby generating the thermite reaction, wherein the gas producing substance produces the gas when the thermite reaction occurs, and wherein the gas, the thermite reaction, or combinations thereof produces a pressure, causing the movable member to move.

12. The method of claim 11, wherein the gas producing substance slows the thermite reaction.

13. The method of claim 11, wherein the gas produced by the gas producing substance is non-extinguishing of the thermite reaction.

14. The of claim 11, further comprising the step of disposing the gas producing substance exterior to the thermite for at least partially enclosing the thermite.

15. The method of claim 11, wherein the gas producing substance is substantially mixed with the quantity of thermite.

16. The method of claim 11, further comprising the step of reducing heat transfer from the thermite reaction to an adjacent object using the gas producing substance, the gas, or combinations thereof.

17. The method of claim 16, wherein the heat transfer from the thermite reaction to the adjacent object raises the temperature of the adjacent object by 1000 degrees Fahrenheit or less.

18. The method of claim 11, further comprising the step of slowing the thermite reaction by using the gas, such that the thermite reaction occurs for a time greater than or equal to one minute.

19. The method of claim 11, wherein the gas producing substance is present in a quantity ranging from 110% the quantity of thermite by weight to 250% the quantity of thermite by weight.

20. The method of claim 11, further comprising the step of using an accelerant to increase the rate at which the thermite reaction occurs.

* * * * *